US007987980B1

(12) United States Patent
Hahn

(10) Patent No.: US 7,987,980 B1
(45) Date of Patent: Aug. 2, 2011

(54) BRUSH GLOVE

(76) Inventor: Scott Hahn, Massapequa, NY (US)

( * ) Notice: Subject to any disclaimer, the term of this patent is extended or adjusted under 35 U.S.C. 154(b) by 0 days.

(21) Appl. No.: 12/331,996

(22) Filed: Dec. 10, 2008

Related U.S. Application Data

(60) Provisional application No. 61/005,821, filed on Dec. 10, 2007.

(51) Int. Cl.
*B65D 83/10* (2006.01)

(52) U.S. Cl. ..... 206/361; 206/15.2; 206/15.3

(58) Field of Classification Search ..... 206/361, 206/362.2, 362.3, 15.2, 15.3
See application file for complete search history.

(56) References Cited

U.S. PATENT DOCUMENTS 5,244,090 A * 9/1993 Keith ..... 206/361
6,199,694 B1 * 3/2001 Van Diest et al. ..... 206/361
* cited by examiner

*Primary Examiner* — J. Gregory Pickett
*Assistant Examiner* — Andrew Perreault
(74) *Attorney, Agent, or Firm* — Edwin D. Schindler

(57) ABSTRACT

A paintbrush protection and revitalization system includes a case having a paintbrush support shelf with graduated bristle support projections and tapered tip support therein. The case has auto-convection ports, an air induction port and a brush insertion port. The auto-convection ports include at least one air inlet port and at least one water vapor exchange port for reducing drying time of a paintbrush contained within the case. A living hinge connects a cover to the case with the case, the cover and the living hinge being an integrally-molded unit, which is preferably made of plastic.

8 Claims, 6 Drawing Sheets

BRUSH GLOVE

CROSS-REFERENCE TO PROVISIONAL PATENT APPLICATION

Domestic priority is hereby claimed, pursuant to 35 U.S.C. §119(e), from U.S. Patent Provisional Application No. 61/005,821, filed Dec. 10, 2007, the entire disclosure of which shall be deemed to be incorporated by reference herein.

BACKGROUND OF THE INVENTION

1. Technical Field of the Invention

When paint brushes are first fabricated, manufacturers use a compound called "sizers" that allow for the initial drying of the newly formed bristle groups of the paintbrush to create a sharp, tight, and defined angled tip of the bristles; not dissimilar to the way starch can be used on a shirt to keep its shape when ironed flat. After the brush has been used and cleaned, much of the "sizing" is removed and the bristles no longer have a natural ability to re-form themselves back into a sharp, tight, and well-defined bundle tip.

The present invention, unlike other protection apparatus, relates to an apparatus that offers both protection and the revitalization of a drying paintbrush, thereby greatly extending its useful life, and allow a brush to dry faster than if left out in open air.

2. Description of the Prior Art

A simple use of a protection device for a paintbrush is known in to the prior art. The prior art configurations of the previously specified inventions all use commonly understood case structures, typically of a main body and a cover.

Specifically to the point of this invention, known prior art can be inclusive of U.S. Pat. Nos. 1,239,638; 4,207,977; 5,244,090; 6,199,694; and 6,338,406. While these prior art devices do fulfill their respective particular objectives and requirements, these aforementioned patents do not address the specific claims of this present invention.

One of the original concepts of paintbrush protection systems, Throckmorton, U.S. Pat. No. 1,239,638, offers a standing device that more depends on drip-drying of the bristle body. In Throckmorton, the brush is held within the device with the handle facing up, thereby preventing the auto-convection forces to be created as is done in this present invention.

Both Kronfeld, U.S. Pat. No. 4,207,977; and Van Diest, U.S. Pat. No. 6,199,694, offer a slip on brush protector, not unlike a sheath. However, the dried brush must be retrieved from the sheathed holder in the opposite direction of insertion. The reversed action of brush removal causes the bristle bundle to be crushed against the walls of the protection sleeve, resulting in potentially permanent bending and crushing damage to the fine structure of the bristles; all of which is eliminated by the design of the present invention.

In addition, Zagar, U.S. Pat. No. 6,338,406, is also dissimilar to the present invention in that, although it provides for air/water vapor exchange holes, Zagar makes no provision for allowing the lighter gas exchange of water vapor and heavier air to create an auto convectional drying process resulting in faster drying than can be obtained in open air, or in a containment clamshell as specified in Zagar. In addition, Zagar offers a common metallic hinged spring-loaded clamshell approach, which yields the additional problem of the rusting and failure of the containment vessel hinge and inability to hold the brush inside.

Keith, U.S. Pat. No. 5,244,090, offers a device without any external air exchange. Although Keith offers a bristle support from handle to mid brush with opposing support, the major drawback is that it is a solid form and does not allow for the bristles to be exposed to air for the purpose of rapid drying as is the unique feature of this invention as this invention uses the physics involved with dual density gas exchange to produce auto-convection. In Keith, the area of the brush bristles exposed to air for the purpose of drying is uneven, and as such will cause the bristles to bend as they approach a dry condition, thereby separating the bristles; defeating the entire purpose of the device. Although Keith does protect the brush, the resultant drying does not produce the same sharp, tight, and aligned bristle body tip that this present invention can create.

None of the discovered prior art addresses the special needs of the square tipped versus the tapered tip brush, as does this present invention. The present invention exclusively allows for bristle bundle containment, constriction, and formation of the bristle body during the drying process unique to each of the specific needs of both squared tipped and tapered tipped brushes.

No prior art, with regard to brush protection devices, offer built in means by which the bristle bundles can be reformed into their straight and parallel positions prior to the drying process using an integral comb for this specific purpose, as does this present invention. This invention exclusively offers an integrally molded comb by which a freshly cleaned brush can have its bristles reconfigured from a state of disarray after cleaning to a state where the bristle bundle is once again in the proper straight, tight, and parallel position needed prior to drying.

No prior art found address the forming of a vibration energy absorbing hinge structure that is integrally formed in the uni-body molded structure that is the present invention, producing anti-shattering properties as well as a more securely closed device that is virtually incapable of breaking or popping open.

In these respects, the paintbrush protection apparatus of this present invention does not conform to the prior specified conventional approaches and concepts detailed within any prior art, and represents a new and more novel approach to the protection of the bristle bundle of a brush from damage, as well as the revitalization of said bristle bundle during the drying process, allowing the bristle bundle of a paintbrush to approach a state that draws close to being new each and every time the brush is cleaned and dried.

With respect to the known disadvantages inherent in the designs of the known brush protections systems available within the body of the prior art, the present invention provides a new approach, and additional features to those seen in prior art, for the purpose of yielding a device that offers protection of paintbrush bristle bundles from permanent damage, and the formation of revitalized dried bristle bundles that are sharp, tight, and in the required pointed form.

SUMMARY OF THE INVENTION

It is, therefore a primary object of the present invention to produce a brush protection system that is the easiest to fabricate, easiest for a consumer to use, and uses the state of the art in thermoplastic injection molding techniques.

The foregoing and related objects are achieved by the present invention, which provides a molded in high strength plastic that offers a case, cover, living hinges, case to cover locks, auto-convection ports, air induction ports, brush insertion port, brush support shelf, tapered tip support, an external storage hanger, and an exclusively available brush bristle comb, all in a single molded piece.

In order to attend to the prominent addressable problems of paintbrush maintenance, which can be specified as protection of the bristle shafts from bending and breakage damage, and the reformation of the drying bristle bundle into a tight and sharp form that simulates the original configuration of the brushes bristles, several features were researched and designed in an optimized form within this invention.

Novel to this present invention is the integral bristle comb that allows a user to straighten the elements of the bristle bundle by "combing them" into their original in-line positions prior to being dried for their next use; drying the bristle bundle while they are straight and in the proper parallel position of each other is critical in the preservation of the longevity of a paintbrush. The integral bristle comb feature found exclusively within this present invention leads to greatly extending the useful life of a paintbrush.

The first prominent feature of the present invention is the main body where the paintbrush is held prior to being constrained by the foldable cover. The main body has the ability to contain both square and tapered brushes, offering bristle shaft supports and narrowing constriction of the bristle bundle from the handle of the brush to the tip for both types.

When the molded cover is folded over, using the living hinge molded within the same structure, the bristles of the brush are supported and constricted into a tight bundle within the main body by integral bristle shaft supports, and on the opposite side by integral bristle shaft supports that are also molded into the cover. These bristle bundle support/constriction projections keep the shafts of the bristles both straight and in tight proximity of each other. In addition, the bristle supports taper the bristle bundle into a triangular shape from the handle to tip, maintaining a sharp tip to the brush at the painting edge, which is a critical factor for painters to control the application of paint, and the ability to properly use the brush in practice.

The present invention allows for a separate integral device to be activated that will address the special needs of a tapered tip brush. The angled tapered tip support, also molded into the body of the present invention, allows for the special needs of the tip of the bristle bundle of taper tipped brushes. As a tapered tip, the constriction forces that are required to force the ends of the bristles together in a sharp and tight bundle are different than the forces required for a square tipped brush.

When bent into its activation position, the angled tapered tip support concentrates the constriction forces of the support/constriction projections to the bristle bundles tips, maintaining the industry standard taper of the bristle bundle, insuring that all of the bristle tips, although angled, are kept straight and in tight proximity to each other for proper drying.

Once the cover of the present invention is folded over, holding, supporting, and constricting the bristle bundle into the required sharp and tight form, case-to-cover locking buckles are provided on their own integrally molded living hinges for the purpose of interlocking the case and cover together, keeping the brush and its bristles in the proper protected form until dried. The side mounted interlocking buckles are designed for ease of implementation by the user, and can be locked and unlocked by the use of one finger.

The case and cover of the present invention are attached to each other using an integrally molded living hinge between the two parts. The living hinge between the cover and case runs the full length of the body and creates two novel effects. Although the body of the present invention is injection molded from high strength plastic, this material is not completely shatter-proof if dropped on a hard surface, especially with the weight of a paintbrush inside. The living hinge, once folded over, acts as a spring that can absorb, distribute, and dissipate axial forces between the case and the cover, thereby reducing the internal molecular forces that would cause the body to shatter if it were dropped and was subject to an impact on a hard surface.

A further preferred embodiment of the present invention is an angled brush support at the bottom of the body near the handle of the brush. Should the interlocking buckles not be affixed properly and become dislodged after the brush is hung to dry, the angled brush support at the bottom of the device will create an inward directed normal force that will hold the brush in place and prevent it from falling out, and thereby preventing the falling brush from suffering damage and/or improper drying.

After the present invention is closed and locked, and hanged to dry, the design of this device activates certain physical characteristics of gasses that produce a faster than normal drying time as compared to open air drying.

As an added convenience for the user, molded into the body of the present invention is an external storage support for both standard dual and single fork storage projections. In addition, the case portion of the present invention contains a base projection near the handle opening that holds the body of the protection device at an angle when vertically hanged in its storage position for the purpose of creating additional inward acting forces that would prevent the brush from falling out of the protection device if the cover were dislodged or intentionally opened.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals and symbols denote similar features throughout the several views.

DETAILED DESCRIPTION OF THE PREFERRED EMBODIMENTS AND DRAWING FIGURES

Figure 1:
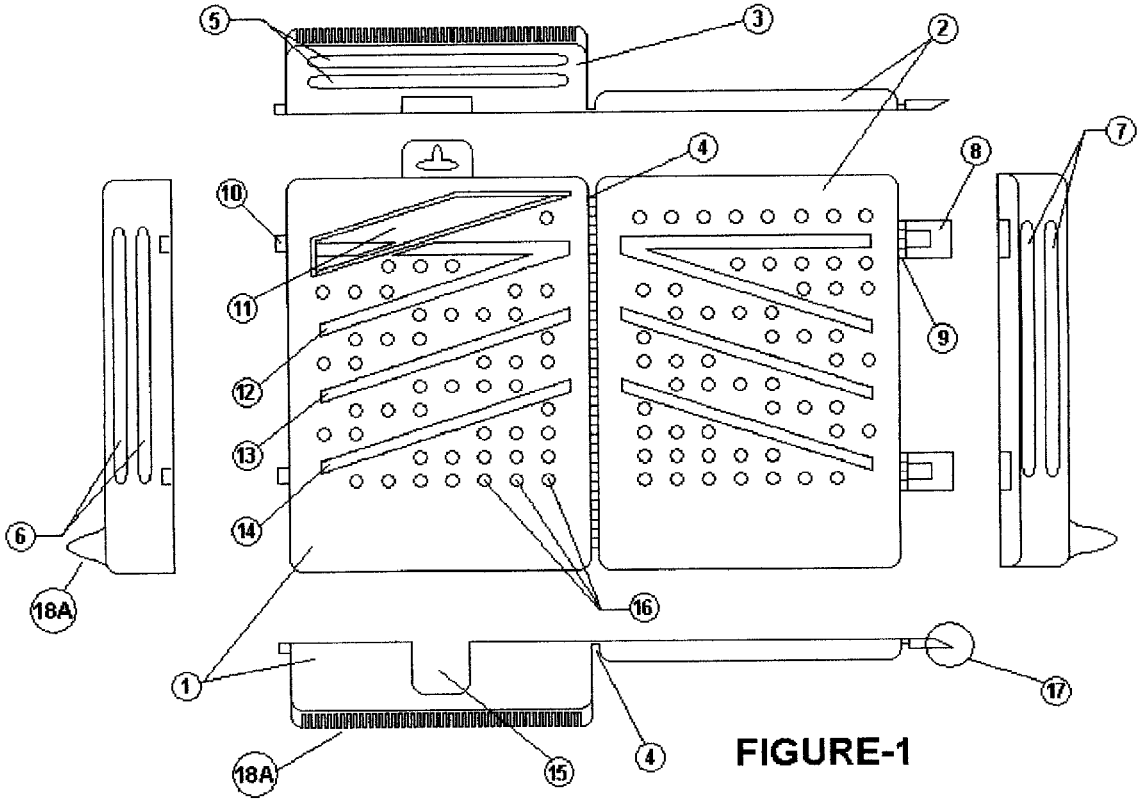
FIG. 1 is a plan layout of the main injection molded, single piece construction of the present invention, showing the case, cover, living hinges, locks, auto-convection ports, drying ports, brush insertion port, brush support shelf, tapered tip support, bristle bundle comb, and a external storage hanger.

Turning now, in detail, to an analysis of the accompanying drawing, FIG. 1 shows a paintbrush protection and revitalization device, in accordance with a preferred embodiment of the present invention, can initially be described in the form of a case 1, a cover 2, interconnected with a living hinge 4.

Once a paintbrush is cleaned, its bristle bundle now in significant disarray from being disoriented from being initially dried using cloth or towel, can be combed into their straight and proper parallel positions using the integral comb 18A, prior to the paintbrush being placed within the protection and revitalization device.

A paintbrush, once placed into the case 1 of the present invention, has its handle protrude from the handle port 15, and has its bristles supported by the graduated bristle support projections 12, 13, 14, as illustrated in FIG. 1.

Figure 2:
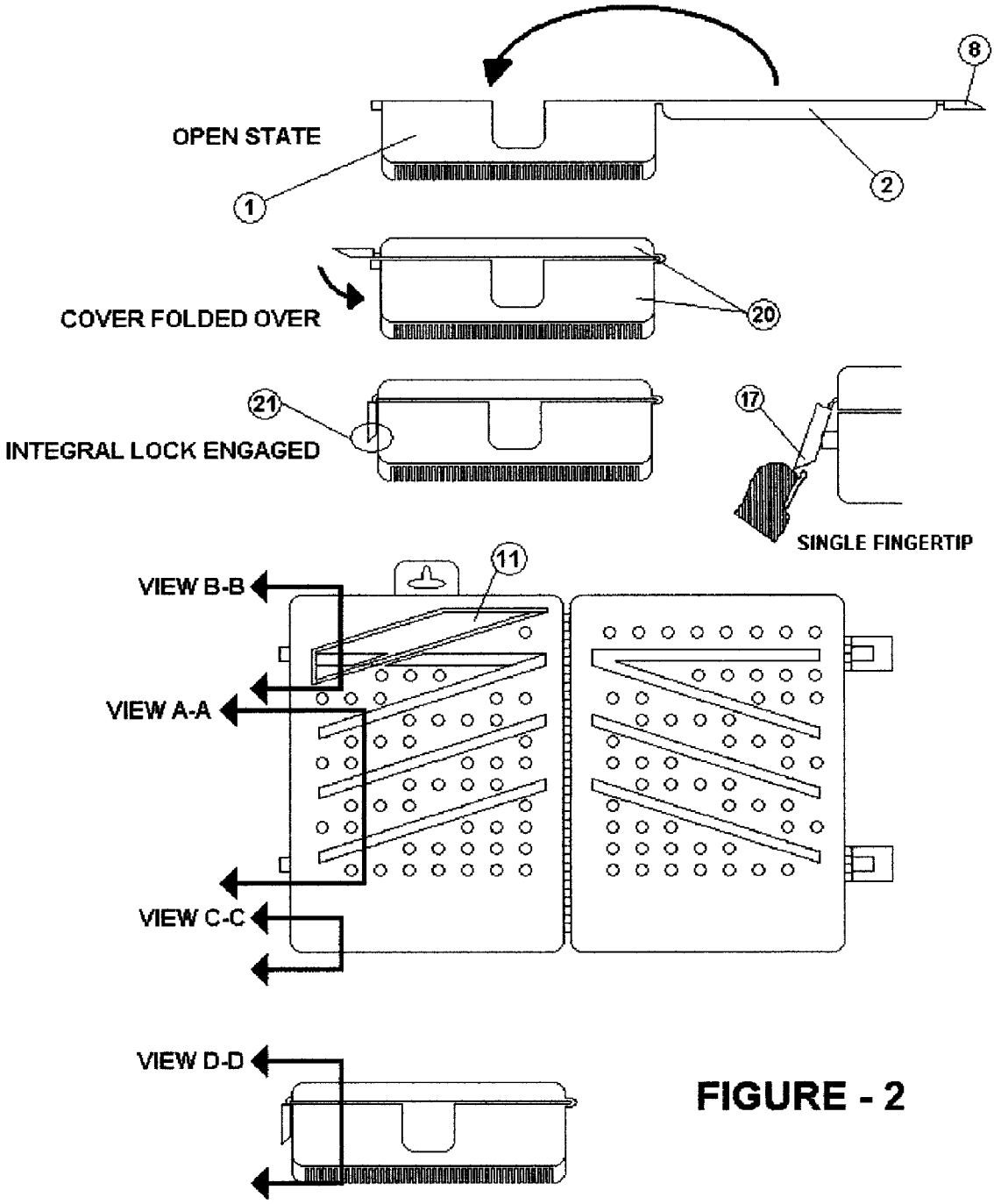
FIG. 2 shows the protection device in the open, folded, and locked positions and further depicts four separate internal cross sectional views of portions of the inner structure of the present invention.
Figure 4:
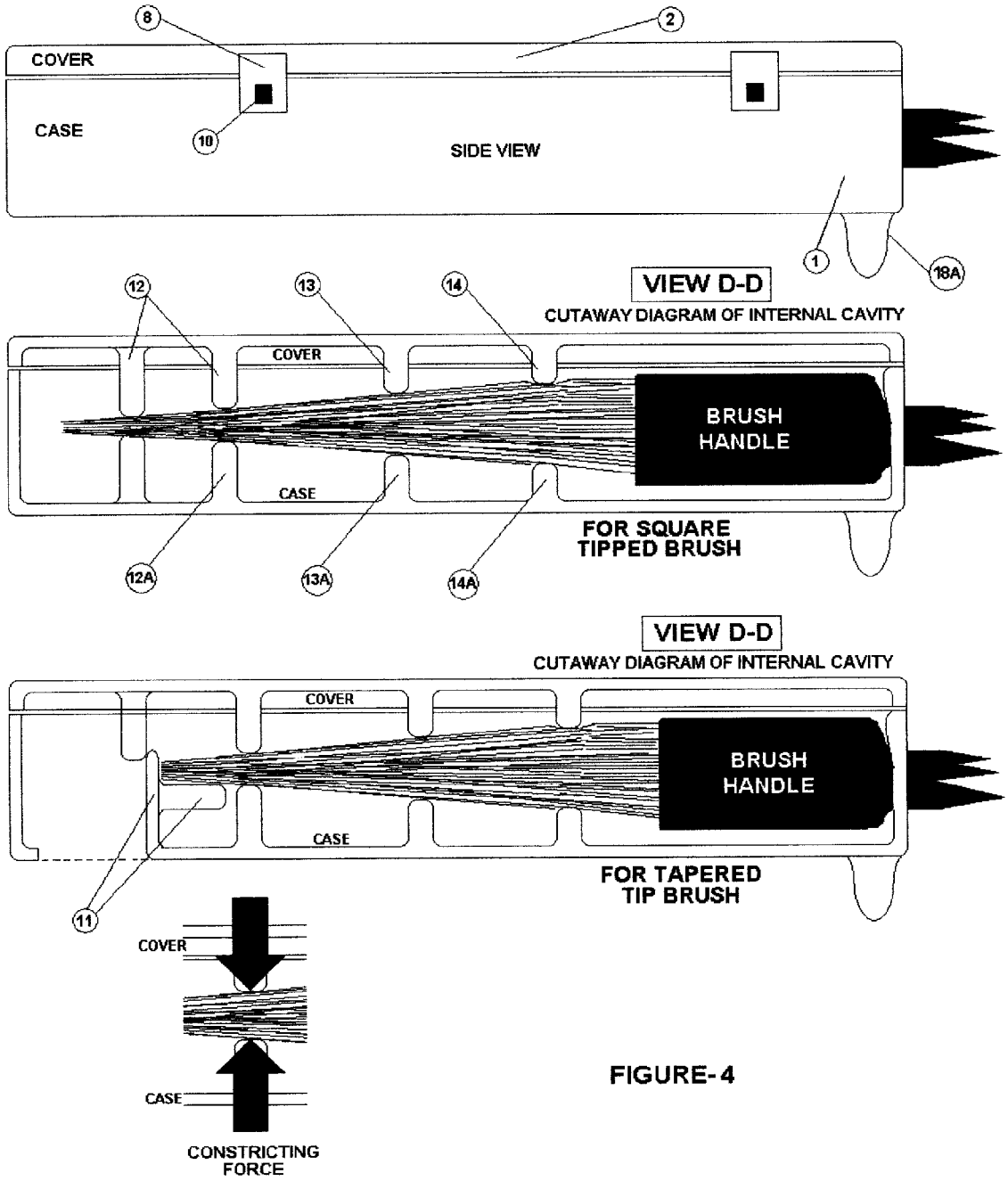
FIG. 4 shows a side view of the present invention in the closed and locked position, and further provides the internal arrangement of the bristle support and constriction projections for both the square and tapered brushes that hold the bristle bundle from the brush handle to the tip.

In folding over the attached cover 2, shown in FIG. 2, the case and cover fit together to form a positive containment for the handle and the bristle bundle (which is also shown in FIG. 4.) Special structural attention was focused on the creation of an interlocking system that is the easiest to employ for the user.

A user can both lock and unlock the case and cover with the use of a single finger-tip, as can be seen in the depiction of the angled locking projection 17, as shown in FIG. 2.

A tapering of the locking projections 17 (see, FIG. 1) allows for the minimum force needed to open the lock, while the angled snap projection of the interlocking parts 8, 10 requires a minimum engaging force. This feature creates an interlocking system that can be employed with the force generated by a single fingertip.

As shown in FIG. 2, the integral case-cover finger actuating locks 21 can be folded over to create a useful binding force between the case and the cover. The positive lock between the case and the cover creates the constriction forces that can be seen in FIG. 4. In FIG. 4, the case-cover lock 8 creates the constriction forces that form the bristle bundle back into the natural angled shape that it had when the paintbrush was new, and holds them into a tight and parallel grouping so that they will dry in that state, greatly extending the life of the brush. It can further be seen that the graduated bristle support projections 12/12A, 13/13A, 14/14A, acting as the jaws of a vise, hold and form the bristles into a tapered shape during the drying process. These projections can also be seen in the cross-sectional view shown as along the A-A line in FIG. 2, and in an exploded view for clarity in FIG. 3.

The graduated bristle support projections 12/12A, 13/13A, 14/14A hold the bristle bundle to produce a sharp and tight bundle of bristles all the way from the handle to the tip, producing, after the drying process is complete, a revitalized brush with the characteristics of a brand new brush.

When the brush is finally dry and removed from the present invention, the bristle bundle will retain the shape in which it was dried. In addition, since the bristles were held in their original tight and rigidly parallel positions, the present invention eliminates permanently misdirected and broken bristles. The misdirected and broken bristles that occur when brushes are not properly dried and protected require removal from the bristle bundle, thereby significantly reduce the overall life of the brush, as well as its effectiveness.

Figure 5:
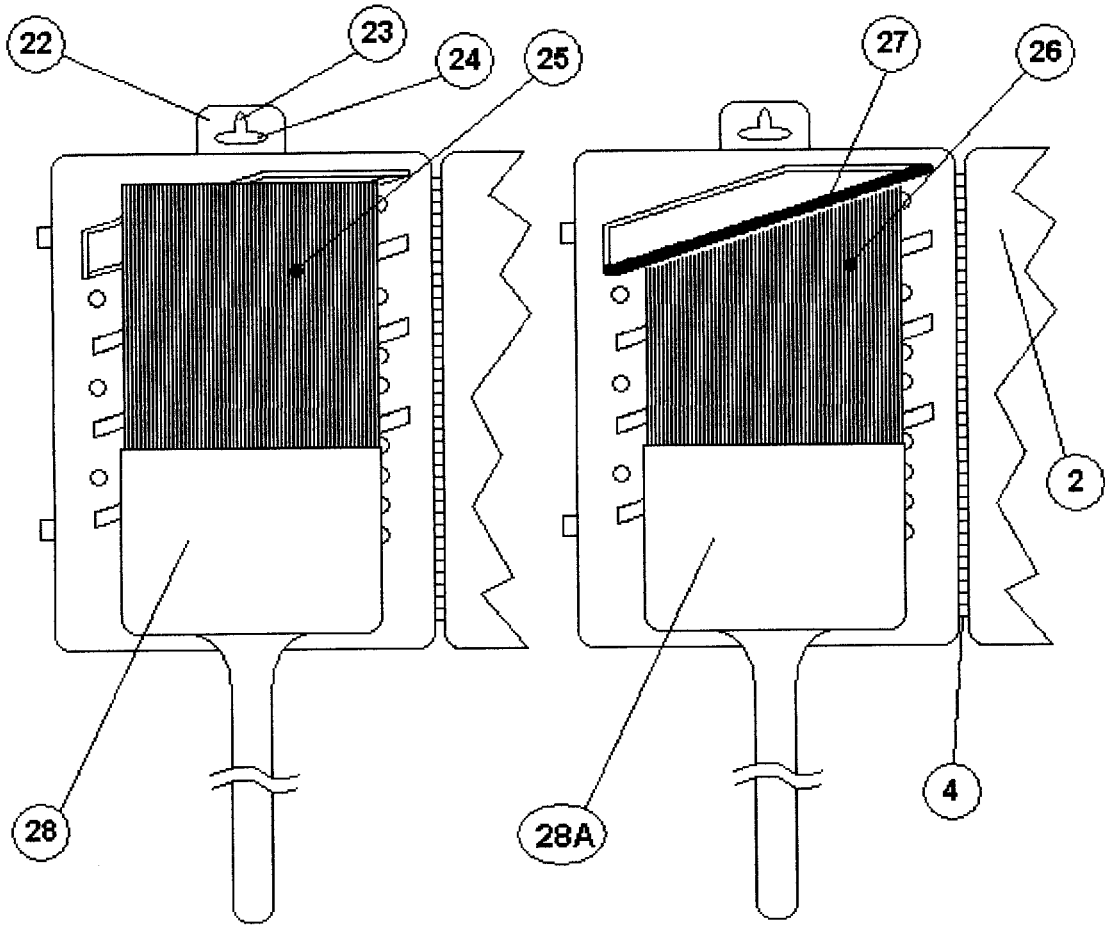
FIG. 5 shows the integrally molded storage holder of the present invention and further provides a depiction of a user paintbrush being held in the main case; and, FIG. 6 shows a paintbrush contained within the present invention and the auto-convection slots that produce the forced air movement for reducing the drying time of the encased paintbrush.

The tapered tip support 11, as seen in FIG. 1, can be seen in use in FIG. 5, depicted as the tapered paintbrush bristle support shelf 27 in its folded-up position, which is its active state. The cross-sectional view of the bristle support shelf 11, as seen along the B-B line of FIG. 2, can be seen in its non-deployed and deployed states in the exploded for clarity views within FIG. 3.

A view taken along the D-D line of FIG. 4 shows the depiction of a paintbrush held within the present invention, while the center diagram shows the holding position of a square tipped brush 28 of FIG. 5, where the bottom view shows the holding pattern for a tapered tip brush. The tapered tip brush requires the implementation of the tapered tip bristle support shelf 11 of FIG. 1, shown in its upright and active position by reference numeral 27 in FIG. 5, and by reference numeral 11 in FIG. 4.

As can clearly be seen in FIG. 5, the tapered tip bristle support shelf addresses the special needs of a tapered tip paintbrush 28A. Since the bristles are of differing lengths in the tapered tip brush, the lateral support that bristles of a square tipped brush 28 give to each other is missing in the case of a tapered tip 28A. The tapered tip bristle support shelf holds the bristle bundle, when in its active position 11 (as seen in FIG. 4) and 27 (as seen in FIG. 5), thereby offering the corrected lateral support of the bristles so that any forces created in the drying process that might warp or misdirect the bristles are overpowered. The results of the drying process create a straight, parallel, and pointed tip brush, ready for use as if new.

Once the case 1 and the cover 2 are closed and locked together using the finger actuated integral folding locking snaps 8, the living hinge 4 creates a spring mechanism novel to the present invention. The spring mechanism properties of living hinge 4 creates a vibration-dampening element that will absorb, distribute throughout the body of the present invention, and dissipate energy that may be induced into the structure of the protection device if dropped on a hard surface, thereby eliminating the possibility of the shattering of the plastic housing or of its undesirably popping open. The very same energy absorbing characteristic is designed into the living hinge 9, used for the finger actuated locking snaps 8, for keeping the case and cover locked.

The living hinges create energies induced by abnormal circumstances can be deflected and dissipated, so that the operation of the interconnected elements of this protection device will not be compromised. The living hinges 4, 9, being integrally molded into the body of the present invention, are therefore made of the very same material. Being of the same material, all the parts of the present invention have the same thermal expansion characteristics, keeping the effectiveness of the lock between the case and the cover from being affected by temperature changes. The living hinges also eliminate the need for metal-to-plastic snap action interconnects that distort over time and suffer breakage failures, leaving the case and cover unable to lock together, therefore rendering the device useless. Because, the living hinges are made of the same material and therefore have the same hardness, and as such, the male-female interlocking parts can not damage or distort each other no matter how many times the interlocking action occurs.

Specific to the construction of the present invention is the auto-convectional nature of the drying ports and gas relief ports. The side vents, which are the drying ports, 6, 7, 16, and which can be seen in FIG. 1, the slots and holes that allow for the drying brush to "breathe." A top vent may also be included by providing drying ports 3, 5, as further illustrated in FIG. 1. Air is primarily comprised of 21% oxygen ($O_2$) and 78% nitrogen ($N_2$). Given the assumption of the homogeneous nature of air, the weight of air is generally given as 29.5 grams/mole at STP. A dedicated gas formation cavity 32 has been created using the space difference in the top section of the present invention where drying gas can collect, and is comprised of water vapor. Water vapor ($H_2O$) weighs 18 grams/mole, thereby representing a lighter (and less dense per given volume) gas than the surrounding air at 29.5 grams/mole.

Figure 6:
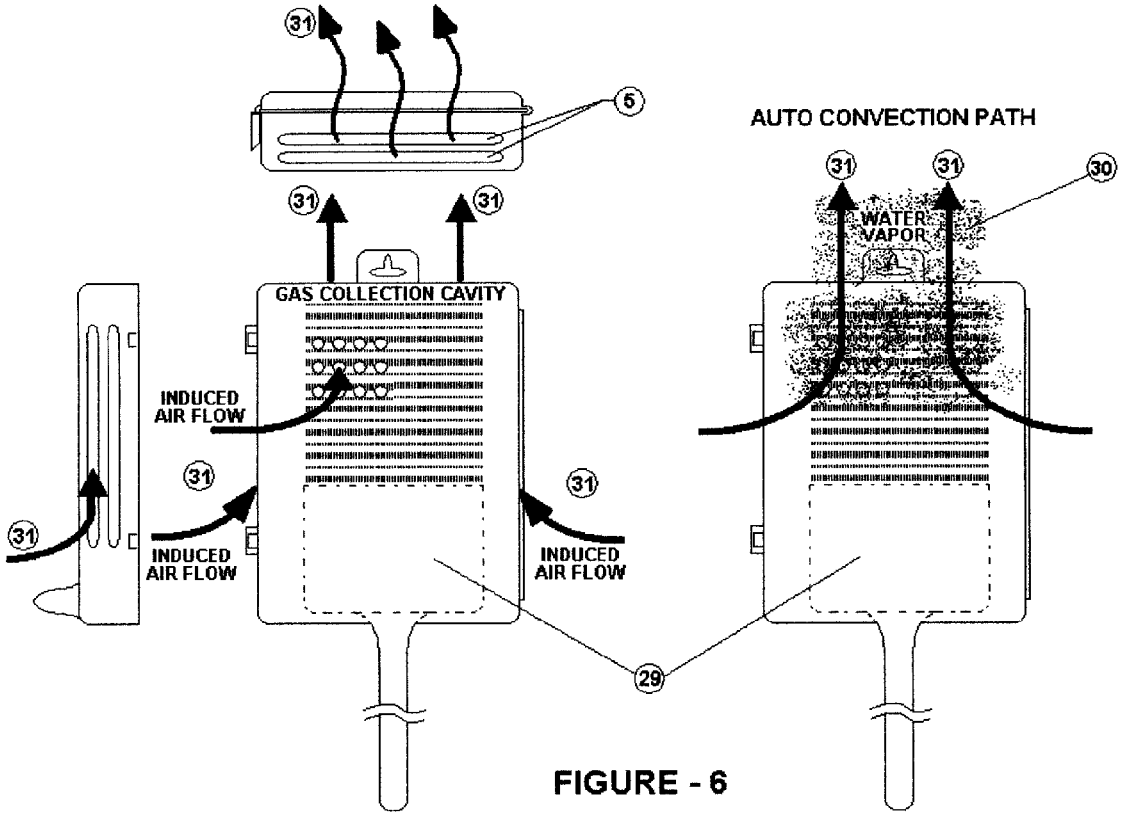

A less dense cloud of water vapor gas 30, as shown in FIG. 6, shows how a controlled exchange of induced inlet air 31, through the side vents 6, 7 of FIG. 1 and vent holes 16 of FIG. 1, produces a forced auto-convection path novel to the present invention. The accumulation of less dense water vapor above the brush creates a molecular action where the less dense gas rises, in turn inducing "make-up" gas to be pulled in from the front and sides to take the place of escaping water vapor gas from the top. This forced auto-convectional path produces a more rapid release of water vapor from the drying paintbrush than if the brush were left to dry in standing air, representing a significant improvement in the design of paintbrush protection, revitalization and drying systems.

Figure 3:
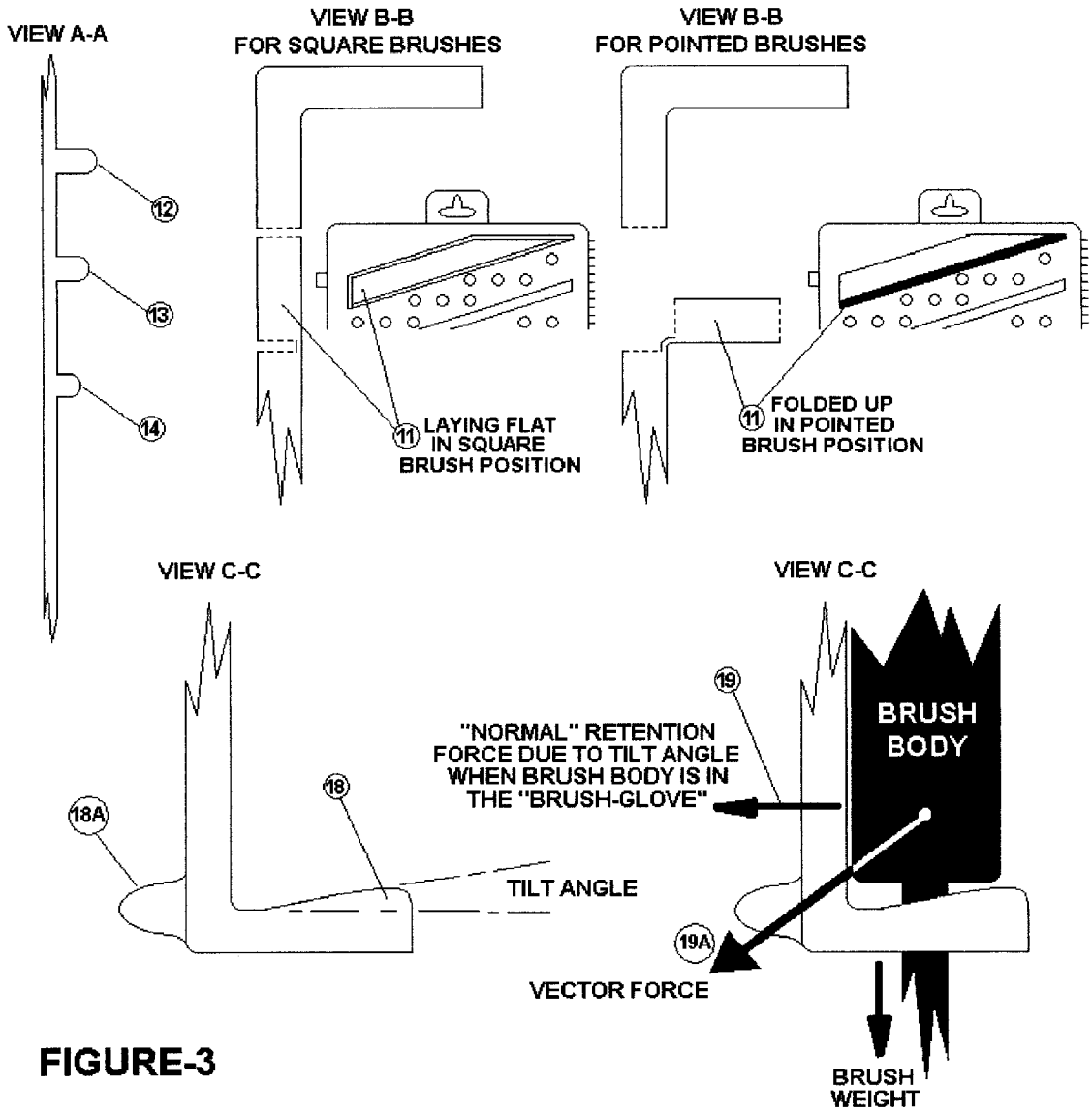
FIG. 3 shows an exploded view of the internal cross sectional views presented in FIG. 2.

An additional molded feature is the integral storage appendage, as denoted by reference numerals 22, 23, 24 in FIG. 5. This storage appendage is specifically designed to accommodate the industry standards. Molded into the bottom of the case, around the brush insertion port, is an angled support shelf 18, as shown in FIG. 3. After initial drying, even while the device is still hanging from its integral support bracket, the case to cover locks can be opened and the cover be swung open while the backward normal forces 19, created by the angle downward forces (vector force 19A) of the weight of the brush acting on the inclined plane of the support shelf will prevent the brush from falling out of the protection device until intentionally removed.

While only several embodiments of the present invention have been shown and described, it will be obvious to those skilled in the art that many modifications may be made to the present invention without departing from the spirit and scope thereof.

What is claimed is:

1. A paintbrush protection and revitalization system, comprising:

a case having a paintbrush support shelf with graduated bristle support projections and tapered tip support therein, said paintbrush support shelf having an angled foldable section for accommodating a square-bristled paintbrush in a flat-lying position of said foldable section and having a folded-up position that conforms to the shape of a tapered-bristled paintbrush for accommodating a tapered-bristled paintbrush in a folded-up position of said foldable section, said case having auto-convection ports, an air induction port and a brush insertion port;

a cover for said case; and, a living hinge connecting said cover to said case with said case, said cover and said living hinge being an integrally-molded unit.

2. The paintbrush protection and revitalization system according to claim 1, wherein said case, said cover and said living hinge are made of an integrally-molded plastic.

3. The paintbrush protection and revitalization system according to claim 1, further comprising a finger-activated locking mechanism for locking said cover to said case.

4. The paintbrush protection and revitalization system according to claim 1, further comprising a comb for straightening and aligning of bristles of a paintbrush.

5. The paintbrush protection and revitalization article according to claim 1, wherein said case includes a paintbrush handle port.

6. The paintbrush protection and revitalization article according to claim 1, wherein said auto-convection ports of said case include at least one air inlet port and at least one water vapor exchange port for reducing drying time of a paintbrush contained within said case.

7. The paintbrush protection and revitalization article according to claim 1, wherein said case includes a top-mounted flange for permitting storage.

8. The paintbrush protection and revitalization article according to claim 1, wherein said living hinge connecting said cover to said case extends an entire length of said case.

* * * * *